US005285246A

United States Patent [19]

Danzuka et al.

[11] Patent Number: 5,285,246

[45] Date of Patent: Feb. 8, 1994

[54] IMAGE FORMING METHOD AND APPARATUS THAT MAINTAINS UNIFORM IMAGE GLOSSINESS

[75] Inventors: Toshimitsu Danzuka, Tokyo; Takashi Kawai, Yokohama; Takahiro Kubo, Tokyo; Tetsuya Atsumi, Kawasaki, all of Japan

[73] Assignee: Canon Kabushiki Kaisha, Tokyo, Japan

[21] Appl. No.: 937,167

[22] Filed: Aug. 31, 1992

[30] Foreign Application Priority Data

Aug. 30, 1991 [JP] Japan ..... 3-245248
Oct. 30, 1991 [JP] Japan ..... 3-311796

[51] Int. Cl.[5] ..... G03G 15/20

[52] U.S. Cl. ..... 355/282; 355/326 R; 430/124

[58] Field of Search ..... 355/328, 327, 326, 285, 355/282, 77; 430/98, 99, 124; 118/645; 346/157

[56] References Cited

U.S. PATENT DOCUMENTS 5,041,877 8/1991 Matsumoto ..... 355/326 X
5,160,969 11/1992 Mizuma et al. ..... 355/326

FOREIGN PATENT DOCUMENTS 62-180379 8/1987 Japan .
63-296065 12/1988 Japan .
63-300254 12/1988 Japan .

*Primary Examiner*—R. L. Moses
*Attorney, Agent, or Firm*—Fitzpatrick, Cella, Harper & Scinto

[57] ABSTRACT

There is provided an image forming method an apparatus and includes a first toner image formation step for forming a first color toner image of magnetic toner; a first image transfer step for transferring the first color toner image onto a transfer material; a second toner image of a non-magnetic toner formation step for forming a second color toner image; a second image transfer step for transferring the second color toner image on the first color toner image on the same transfer material; an image fixing step for simultaneously heating and fixing the first color toner image and the second color toner image on the transfer material; wherein a glossiness of the magnetic toner for the first color toner image is lower than that of the non-magnetic toner for the second color toner image.

11 Claims, 11 Drawing Sheets

IMAGE FORMING METHOD AND APPARATUS THAT MAINTAINS UNIFORM IMAGE GLOSSINESS

FIELD OF THE INVENTION AND RELATED ART

The present invention relates to an image forming method and apparatus in which plural color toner images overlaid on a transfer material, are simultaneously heated and fixed. In a conventional color copying machine of an electrophotographic type, a color image on an original is separated into red (R), green (G) and blue (B) images which are read by a photoelectric transducer, which in turn produces cyan (C), magenta (M) and yellow (Y) (complementary colors) image signals and also block (BK) signals. Then, images are formed with four color toners, i.e., yellow, magenta, cyan and black color toners. By using the black toner, the black component as a mixture of YMC colors is replaced with the black (background color removal). This is advantageous because of the following:

(1) The density reproduction is improved in the high image density area:

(2) Stabilization of color reproduction in the non-chromatic zone:

(3) Improvement in the sharpness: and (4) Reduction of running cost due to the reduction of the toner consumption.

Conventionally, the black toner image is formed at the end, and therefore, the black toner image is overlaid on the Y, M and C toner images.

On the other hand, recently, the color copying machine are used to take black and white copies as well as color originals in offices. Therefore, the color copying machine is preferably capable of producing black and white copies at better cost/performance.

In such cases, the frequency of the black and white copies is larger than that of color copies. In other words, the integral operating time of the Y, M and C developing devices is generally larger than the operating period of the BK developing device.

For this reason, the durability of the black toner contained in the black developing device is preferably higher than chromatic color toners in the Y, M and C developing devices. In order to increase the color image reproducibility after the heat-fixing, the color toners used in the Y, M and C developing devices have a relatively low fusing point. However, the black toner has a relatively high fusing point for the reason described above. In addition, the developers used in the Y, M and C developing devices are desirably not one component magnetic developer from the standpoint of color reproducibility, but the black developing device can use the one component magnetic developer, and the one component magnetic developer is better from the standpoint of running cost. However, since the black magnetic toner includes magnetic particles, the fusing point is higher than the non-magnetic toners of Y, M and C colors.

When the high fusing point black toner image is overlaid on the low fusing point toner images, as a top layer, the image comes to have different glossiness after the image fixing by heat with the result of a poor image. This will be explained in detail.

In the fixing process for fixing a color image on a transfer material, the Y, M and C color toners are fused by heat, but the black toner is not sufficiently fused.

Therefore, the portion of the image that has the black toner top layer, has pits and projections microscopically, so that the light incident on such a portion is diffusedly reflected with the result of less glossy surface. On the other hand, the surface of the portion of the image that has other chromatic color toners is smooth even when it is seen microscopically, and therefore, the light incident on the surface is specularly reflected, so that the portion is glossy. In the case of black magnetic toner, the surface of the image seems roughened due to the existence of the fine magnetic particles. This also decrease the glossiness. For these reasons, when, for example, a photograph of a persons face is copied, the glossiness is different in the skin area than in the hair area, so that the copied image seems poor.

On the other hand, when a black and white copy is to be produced from an original containing characters, that is, when the copy image is produced only by black toner, the less glossy image is preferable.

SUMMARY OF THE INVENTION

It is an object of the present invention to provide an images forming method and apparatus with which evenly glossy image can be provided even if plural toners having different glossinesses are used.

It is another object of the present invention to provide an image forming method and apparatus with which an evenly glossy image can be provided with the use of one or more color toners and a black toner having a higher fusing point.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
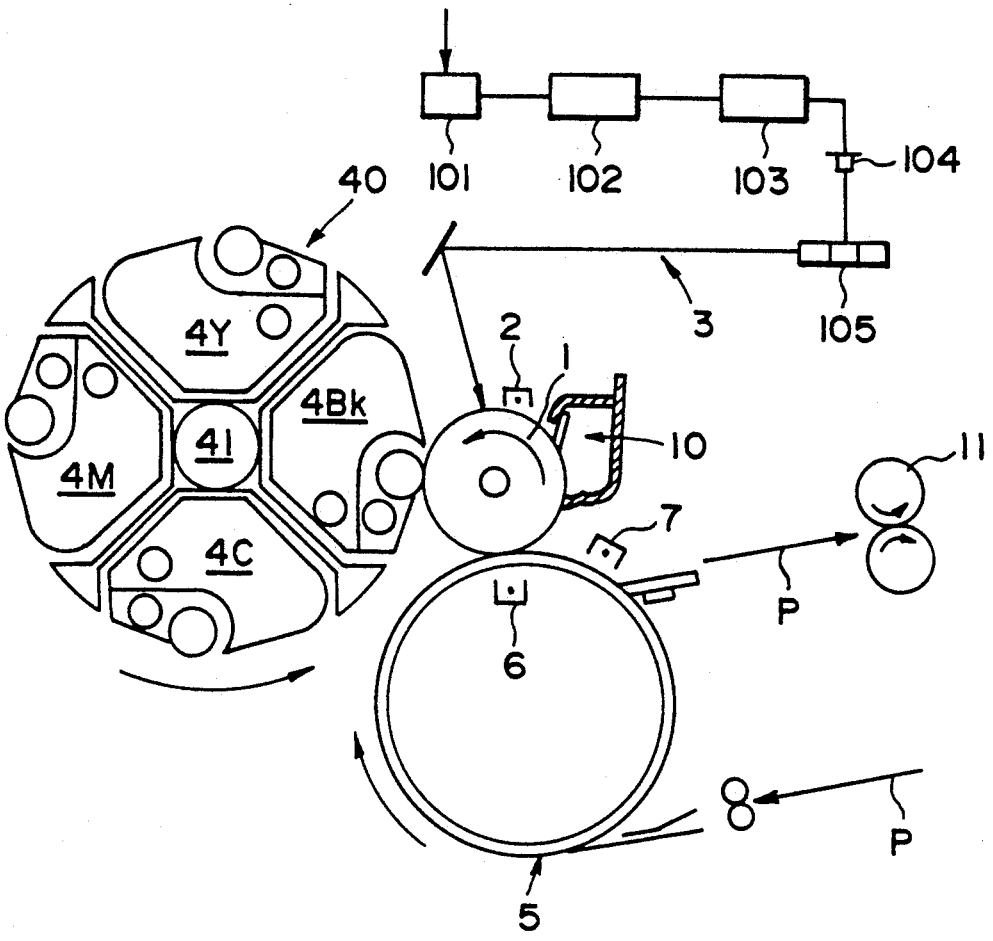
FIG. 1 is a sectional view of an image forming apparatus according to an embodiment of the present invention.

Referring now to FIG. 1, there is shown an image forming apparatus in which an image bearing member 1 in the form of an electrophotographic photosensitive drum is rotated in the direction of an arrow, and is uniformly charged by a charger 2. It is then exposed to a light beam modulated in accordance with the image to be recorded, through laser beam exposure means 3.

The exposure means 3 comprises a D/A converter 101 which receives C, M, Y and BK color separated image signals from a color image processor circuit not shown. The C, M, Y and BK digital image signals are digital-analog-converted D/A converter 101, for respective colors. Then, they are voltage/time-converted by a V/T converter 102. They are then fed to a laser driver 103 for driving the semiconductor laser 104. The driver 103 controls the laser 104 emitting time corresponding to the image signal. The emitted laser beam is incident on the photosensitive drum 1 by a scanning laser optical system including a collimator lens, a polygonal mirror 105 or the like, so that electrostatic latent images for the respective colors are formed on the photosensitive drum 1 in accordance with the associated image signals.

The latent images are developed by yellow developing device 4Y, magenta developing device 4M, cyan developing device 4C and black developing device 4BK which are rotatably mounted on a rotary type developing device 40 which is rotatable about a shaft 41. By the rotation of the developing device, the proper ones of the four developing devices is presented to a common developing position. The visualized (toner powder) images are transferred by a transfer charger 6 onto a recording sheet P which is electrostatically attracted and carried on a rotatable transfer drum 5.

On the other hand, after the image transfer operation, the photosensitive drum 1 is cleaned by cleaning means 10 so that the residual toner is removed and is prepared for the next image forming operation.

In the similar manner, the respective color toner images are sequentially formed on the photosensitive drum 1, and the second color, third color and fourth color toner images are transferred and overlaid on the same recording sheet P. The recording sheet having overlaid toner images is separated from the transfer drum 5 by the separation charger 7, and the recording sheet is fed to a fixing device where the four color toner images are simultaneously heated and fused to be fixed. Thereafter, the recording sheet is discharged out.

According to this embodiment of the present invention, the color image forming steps are carried out in the order from the less glossy toner. That is, assuming that the glossiness of the toner increases in the order of black (BK), cyan (C), magenta (M) and yellow (Y) toners, the rotary developing device 4, as shown in FIG. 1, comprises a black developing device 4BK, a cyan developing device 4C, a magenta developing device 4M and a yellow developing device 4Y as viewed in the upstream direction with respect to the rotational direction thereof, and the latent image developing process starts with the black (BK), followed by cyan (C), magenta (M) and yellow (Y).

The glossiness of the toner, as used in the Specification, does not mean the glossiness of the individual toner particles but means the glossiness of a solid image which is produced with the same amount of toner per unit area and is heated and fused by the fixing device used in the image forming apparatus. The glossiness of the sample solid images is measured through a method defined in JIS-Z 7841 (60 degree method).

Figure 2A:
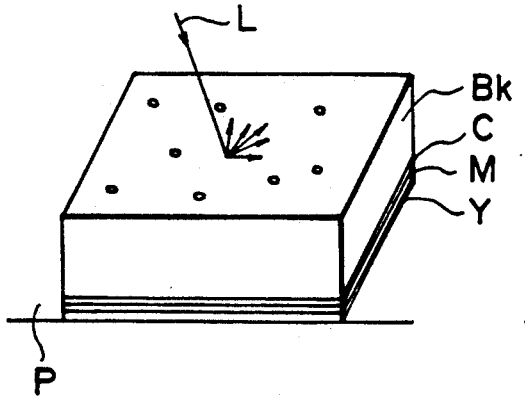
FIG. 2A PRIOR ART
FIG. 2A illustrates a toner image produced by a conventional method.
Figure 2B:
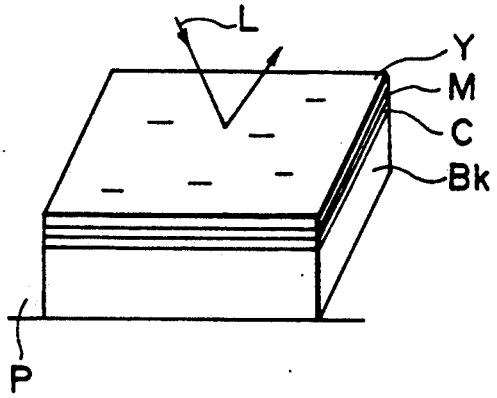
FIG. 2B illustrates a toner image produced by an embodiment of the present invention.

FIG. 2B shows color mixture of the image (toner image) formed in the manner described above. In FIGS. 2A and 2B, the color mixture of the toner is microscopically shown when a non-chromatic color (gray) is color-reproduced. The non-chromatic color is reproduced by black production through a skeleton black system and by mixture of black toner (background color removal) and slight C, M and Y toners.

In both of FIGS. 2A and 2B, the same color is reproduced by mixture of cyan (C), magenta (M), yellow (Y) and black (BK) toner particles. In the case of FIG. 2A, the toner particles are overlaid on the order of yellow (Y), magenta (M), cyan (C) and black (BK) from the bottom layer. In FIG. 2B, the black toner (BK) is at the bottom, and the other color toner are overlaid thereon.

As described hereinbefore, in FIG. 2A manner of toner overlaying, the black toner (BK) is not sufficiently fused after the image fixing process and still exists at the top, and therefore, the surface of the image involves fine pits and projections, so that the light L incident on the surface of the image is diffused with the result of less glossy image. On the other hand, in FIG. 2B, the black toner (BK) is at the bottom, and color toners are overlaid thereon, and therefore, the color toner layers are formed on the black toner, and therefore, the surface of the image is smooth. For this reason, the glossiness of the surface of the formed image is the same as in a single color toner image.

The toners used in this embodiment are as follows:

Black toner: 100 parts by weight of polyester main binder having a number average molecular weight of approx. 10000, 5 parts by weight of carbon black, 4 parts of by weight of charge controlling agent (CA) and additives.

Yellow toner: 100 parts by weight of polyester main binder having a number average molecular weight of approx. 3500, 5 parts by weight of C.I. Pigment Yellow 17, 4 parts of by weight of CA agent, and additives.

Magenta toner: 100 parts of by weight of polyester main binder having a number average molecular weight of approx. 3500, 4 parts by weight of pigment C.I. Melvent Red 49, 0.7 parts by weight of dye C.I. Pigment Red 122, 4 parts by weight of CA agent, and additives.

Cyan toner: 100 parts by weight of polyester main binder having a number average molecular weight of approx. 3500, 5 parts by weight of phthalocyanine pigment, 4 parts by weight of CA agent and additives.

These four toners are mixed with magnetic carrier particles to provide two component developers to develop the respective color electrostatic latent images.

The developing devices 4BK, 4C, 4M and 4Y use black toner, cyan toner, magenta toner and yellow toner, respectively. As for the developing devices, the mechanical structures may be the same.

Figure 3:
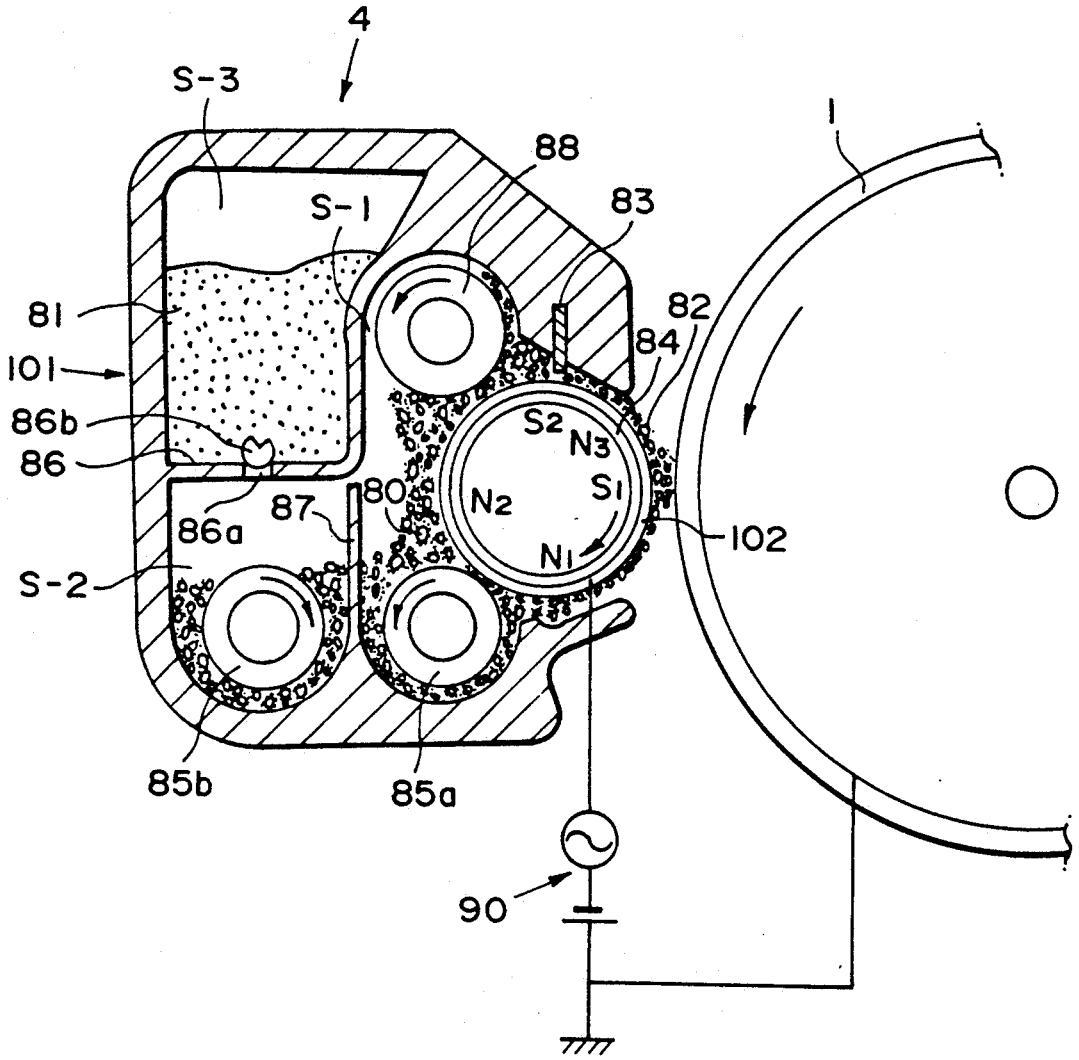
FIG. 3 is a sectional view of a developing device usable with the present invention.

FIG. 3 shows an example of a developing device usable with the apparatus of FIG. 1. The developing device 4 comprises a developer container 101, a developing sleeve 102 functioning as a developer carrying member, a developer layer regulating member in the form of a regulating blade 83 and the like.

Adjacent the photosensitive drum 1, the developer container 101 has an opening, in which the developing sleeve 102 is rotatably supported. The blade 83 is mounted above the developing sleeve 102 with a predetermined clearance from the developing sleeve 102 surface.

The developing sleeve 102 is made from non-magnetic material and is rotated during the developing operation in a direction indicated by an arrow in FIG. 3. In the developing sleeve 102, a magnet 84 is stationarily disposed. The magnet 84 comprises a developing magnetic pole S1 for forming a magnetic brush of the developer in a developing zone where the developer 80 is supplied to the photosensitive drum 1, and conveying magnetic poles N1, N2, S2 and N3 for conveying the developer.

The blade 4 is made from non-magnetic material such as aluminum (Al), and is disposed at a position where the magnetic force of the magnetic pole S2 is influential with a predetermined gap from the surface of the developing sleeve 3. The gap is effective to regulate the amount of the developer 80 to be carried on the sleeve 3 to the developing zone. In this embodiment, two component developer having mixed non-magnetic toner 81 and magnetic particles (carrier) 82, and therefore, both of the non-magnetic toner and the magnetic particles are passed through the gap between the end of the blade 83 and the surface of the developing sleeve 102, and are supplied to the developing zone. The magnetic brush of the developer formed by the magnetic pole S1 in the developing zone, is contacted to the photosensitive drum 1.

Referring to FIG. 3, the conveying pole N1 and the conveying pole N2 adjacent and downstream thereto, have the same polarity so that a repelling magnetic field is produced therebetween. Therefore, the developer which has been carried to the conveying pole N1 on the sleeve 102, is removed from the sleeve 3 by the repelling magnetic field. The removed developer is stirred and mixed by a first screw 85 which will be described hereinafter, and a new developer is fed to the sleeve adjacent the magnetic pole N2.

The inside of the developer container 101 is divided into a developing chamber (first chamber) S-1 and a stirring chamber (second chamber) S-2 by a partition wall 87 extending in a direction perpendicular to the sheet of the drawing of FIG. 3. Above the stirring chamber S-2, there is a toner accommodating chamber S-3 with a partition 86 therebetween. In the toner accommodating chamber S-3, toner (non-magnetic toner) 81 to be supplied is accommodated. The partition wall 86 is provided with a supply opening 86*a*, and a replenishing toner 81 is supplied into the stirring chamber S-2 by controlled rotation of a roller 86*b* having cut-away portions, corresponding to the toner amount consumed for the development. The developer 8 is contained in the developing chamber S-1 and the stirring chamber S-2. At a front end and a rear end in FIG. 3 of the developing device 101, there is no partition wall 87 to provide communication opening (not shown) between the developer chamber S-1 and the stirring chamber S-2.

In the developing chamber S-1 there are a first screw 85*a* which is adjacent the bottom of the developer container 101 adjacent the developing sleeve 102 and which rotates in the direction of an arrow (counterclockwise direction) to feed the developer 8 from the rear side to the front side of FIG. 3, and a second screw 88 which is located above the first conveying means 85*a* and which rotates in the direction of an arrow (counterclockwise direction) to feed the developer from the front side to the rear side of FIG. 3.

In the stirring chamber S-2, there is a third screw 85*b* substantially at the same level as the first screw 85*a* and which rotates in the direction of an arrow (clockwise direction) to stir and feed the developer 80 from the front side to the rear side of FIG. 3.

The developing sleeve 102 is supplied with an alternating bias voltage from a voltage source 90. By the application of the alternating bias voltage to the sleeve 102, an alternating electric field is formed in the developing zone. As for the alternating bias voltage, it is preferably biased with a DC voltage which has a level between the light potential and dark potential of the latent image. The waveform thereof may be rectangular, triangular or sine or the like. The alternating voltage may have alternating positive and negative polarities, but it may be oscillating within the positive or negative voltage.

In the developing device of FIG. 3, the magnetic brush of the developer is contacted to the photosensitive drum 1 in the developing zone. However, the magnetic brush of the developer may be out of contact with the photosensitive drum 1 in the developing zone (so-called non-contact type developing device).

Figure 4:
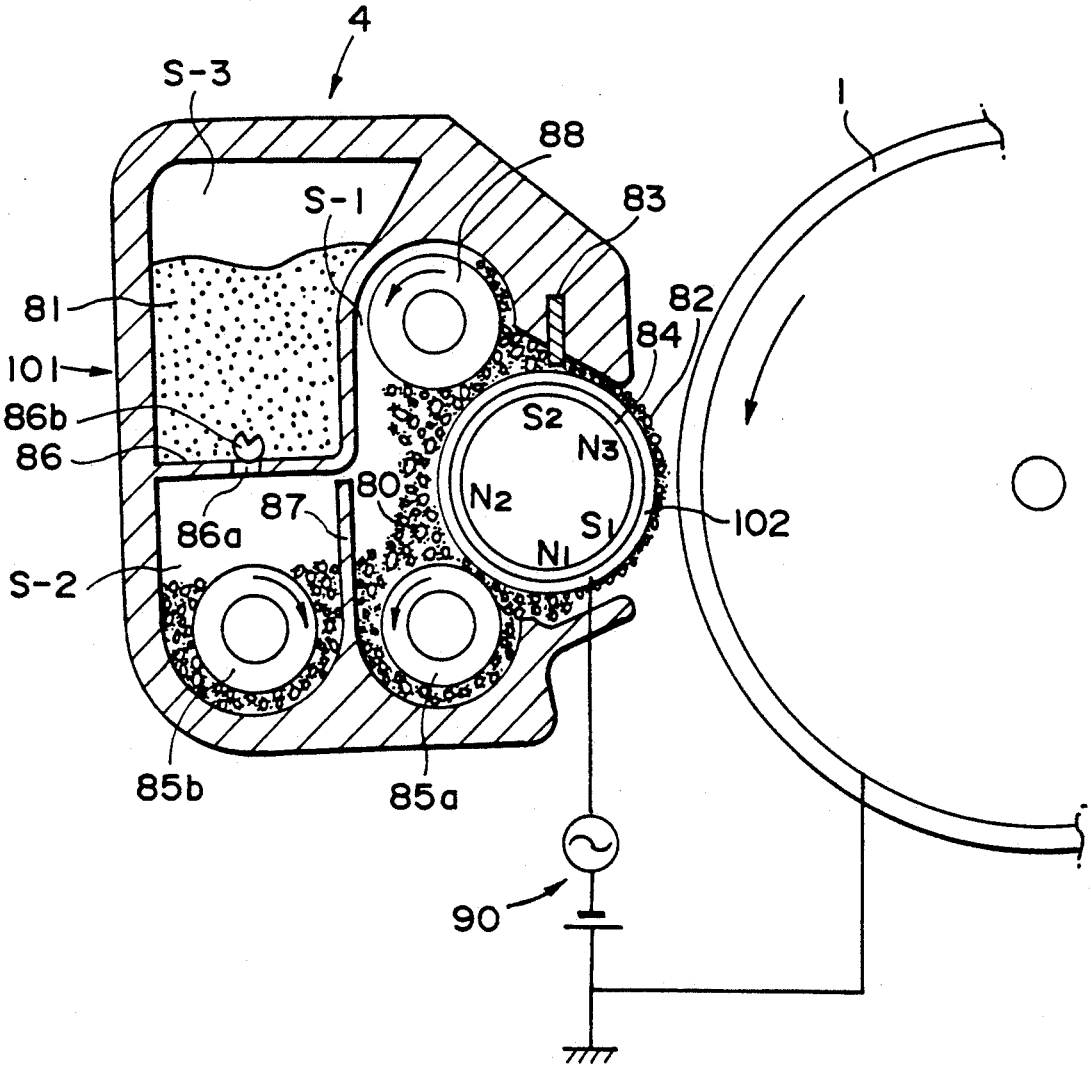
FIG. 4 is a sectional view of a developing device usable with the present invention according to another embodiment.

FIG. 4 shows an example of the non-contact type developing device. The same reference numerals as in FIG. 3 are assigned to the elements having the corresponding functions and the detailed description thereof is omitted for simplicity. In FIG. 4, two adjacent magnetic poles N3 and S1 of a magnet 84, having the opposite polarities, are disposed with the developing zone therebetween. Therefore, in the developing zone, the magnetic brush of the developer rise from the surface of the developing sleeve 102, so that the thickness of the developer layer in this zone is smaller than the minimum clearance between the sleeve 102 and the photosensitive drum 1.

As for the black developing device 4BK using the black toner, it may use a one component magnetic developer rather than the two component developer.

Figure 5:
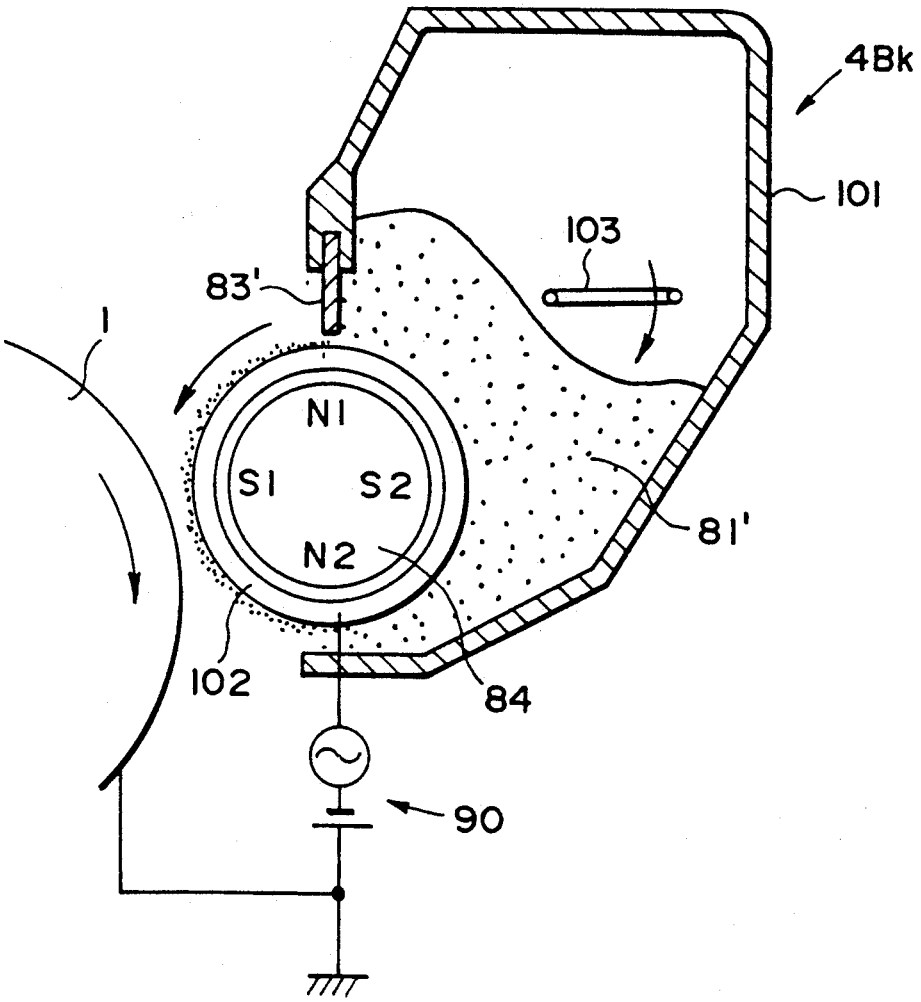
FIG. 5 is a sectional view of a black developing device usable with the present invention.

FIG. 5 shows an example of the one component developer device. The same reference numerals as in FIGS. 3 and 4 are assigned to the elements having the corresponding functions, and the detailed description thereof is omitted for simplicity. In FIG. 5, a one component developer 81' is contained in the container 101. The developer 81' contains magnetic toner particles each comprises fine magnetic particles (magnetite, for example) and a binder resin, and a small amount of silica fine particles. Since the magnetic fine particles are black in color, the magnetic toner is black without addition of another coloring material. However, coloring material may be used. Since the developer contains magnetic fine particles which are not fused by heat in the fixing device, and therefore, the black magnetic toner has a higher fusing temperature than Y, M, C non-magnetic toner. In addition, the surface of the fixed image formed only of the magnetic toner is more rough due to the existence of the magnetic particles, and therefore, the glossiness is low.

The non-magnetic developing sleeve 102 carries the magnetic toner 81' (one component magnetic developer) supplies from the container 101 and rotates in the direction of an arrow, by which the toner is fed to the developing zone where the developing sleeve 102 and the photosensitive drum 1 are faced to each other. In the developing sleeve 102, a magnet 84 is disposed to magnetically attract and retain the magnetic toner 81' on the developing sleeve 102. The toner 81' is triboelectrically charged to such a extent of capable of developing the latent image on the photosensitive drum 1, by the friction with the developing sleeve 102.

In order to regulate a thickness of a layer of the magnetic toner 81' to be fed to the developing zone, a regulating blade 83' made from ferromagnetic metal such as iron or the like is disposed to face to the developing sleeve 102 with a small gap from the surface of the developing sleeve 102. By concentration of the magnetic lines of force from the magnetic pole N1 of the magnet 84, a thin layer of the magnetic toner 81' is formed on the developing sleeve 102. In place of the magnetic blade 83', an elastic blade made of rubber or metal may be press-contacted to the sleeve 102 to form the thin layer of the magnetic toner.

The thickness of the layer of the magnetic toner 81' formed on the developing sleeve 102 is preferably smaller than the minimum gap between the developing sleeve 102 and the photosensitive drum 1 in the developing zone. However, the present invention is usable with a contact type developing device in which the thickness of the toner layer is larger than the minimum clearance between the developing sleeve 102 and the photosensitive drum 1 in the developing zone.

A stirring rod 103 rotates in the direction of an arrow to stir the developer in the container to prevent aggregation thereof.

The sleeve 102 is supplied with an oscillating bias voltage from a voltage source 90 as in the foregoing examples.

The toner usable in this embodiment may comprise 100 parts by weight of polyester main binder 100 having a number average molecular weight of approx. 3500, 60 parts by weight of magnetite, 2 parts by weight of CA agent and additives.

Figure 6:
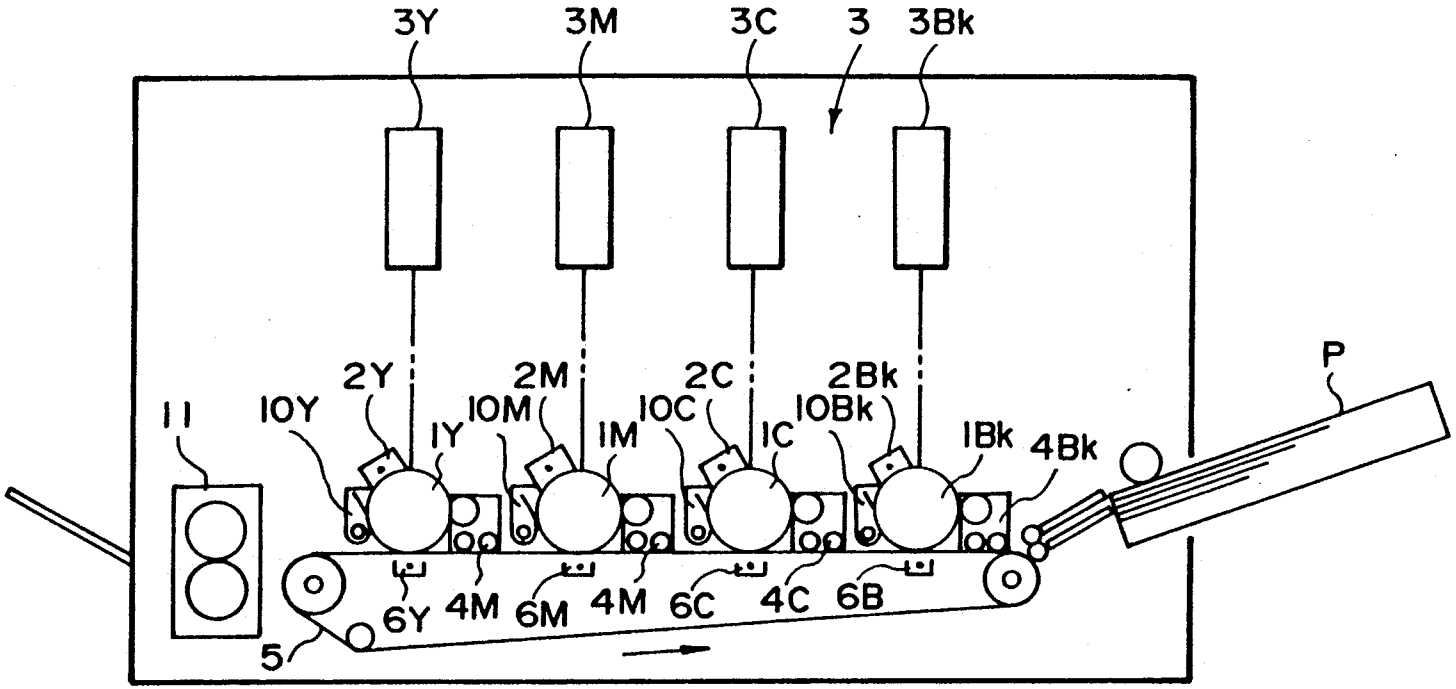
FIG. 6 is a sectional view of an image forming apparatus according to another embodiment of the present invention.

In the embodiment of FIG. 6, an electrophotographic photosensitive drum 1 (1BK, 1C, 1M and 1Y) is provided for each of the colors. Around each of the photosensitive drums, there are disposed a charger 2 (2BK, 2C, 2M and 2Y), a laser beam exposure means 3 (3BK, 3C, 3M and 3Y) and a developing device 4 (4BK, 4C, 4M and 4Y), so that a single color image is formed by each of the photosensitive drum. The single color image formed on each of the photosensitive drums 1BK, 1C, 1M and 1Y, is sequentially transferred onto a recording sheet of paper P carried on the transfer belt 5. The transferred images are simultaneously heated and fixed by the fixing device 11, and the recording sheet P is discharged out. On the other hand, the photosensitive drum 1 (1BK, 1C, 1M and 1Y) is cleaned by cleaning means 10 (10BK, 10C, 10M and 10Y), so that the residual toner is removed.

In this embodiment of the present invention, the toner images of the respective colors are transferred onto the transfer material P in the order from the less glossy toner, that is, in the order of black (BK), cyan (C), magenta (M) and yellow (Y). By this, the same advantageous effects as in the foregoing embodiment can be provided.

The exposure means 3BK, 3C, 3M and 3Y produce laser beams which are modulated in accordance with image signals for black, cyan, magenta and yellow components, respectively.

Each of the developing devices may have the structure described in conjunction with FIGS. 3 and 4. Furthermore, the developing device 4BK may have the structure described in conjunction with FIG. 5.

The cyan toner, magenta toner and yellow toner may have substantially the same glossiness.

Figure 7:
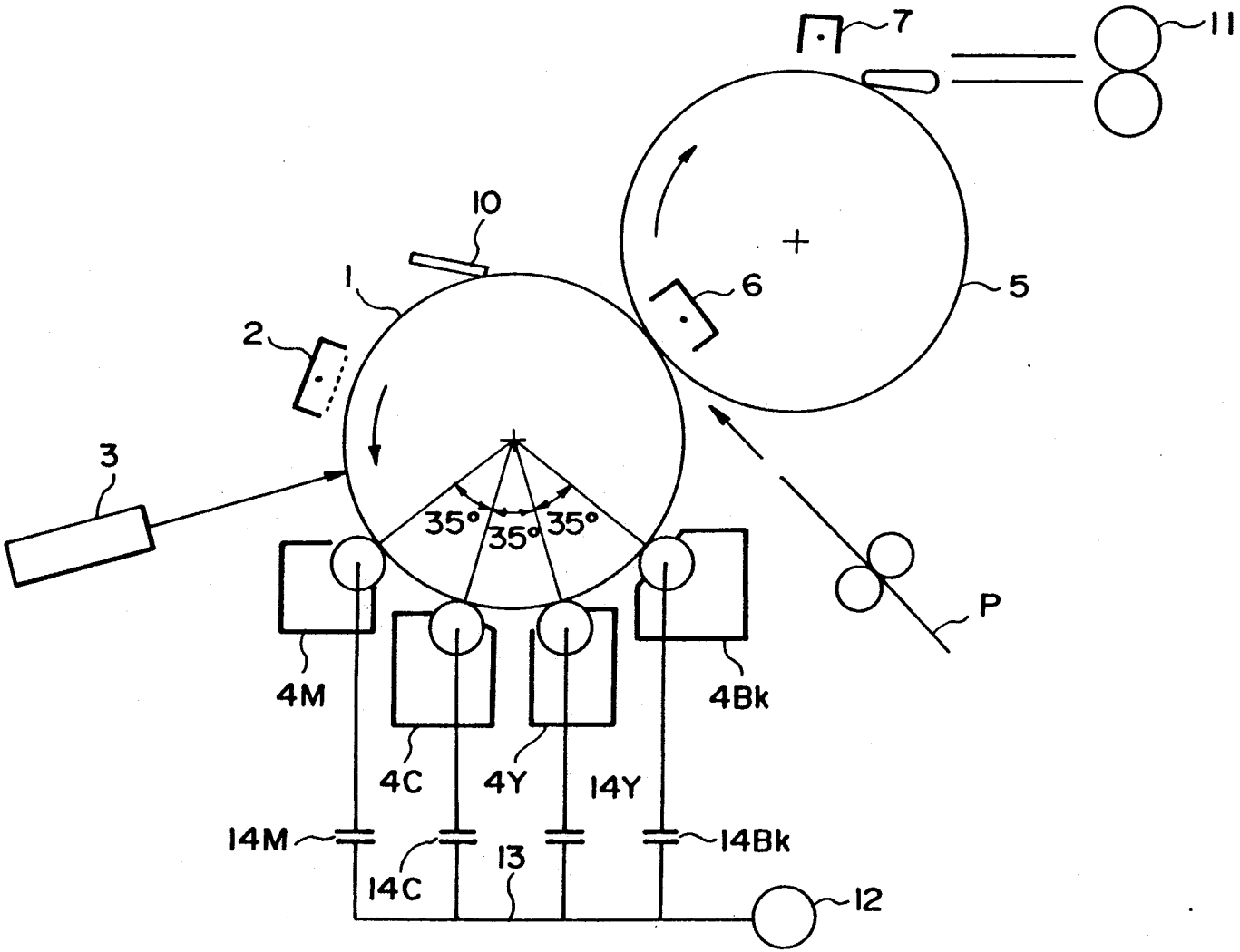
FIG. 7 is a sectional view of an image forming apparatus according to a further embodiment of the present invention.

FIG. 7 shows a further example in which four developing devices are fixedly disposed around one electrophotographic photosensitive drum 1. In this embodiment, the developing devices 4M, 4C, 4Y and 4BK are disposed in the order named toward the downstream with respect to the rotational direction of the drum 1, indicated by an arrow.

The developing devices 4M, 4C and 4Y use two component developers each containing non-magnetic toner and the magnetic carrier particles. The developing device 4BK uses a one component magnetic developer. The magenta, cyan and yellow toners have similar glossiness, but the black toner has a higher fusing point than these toners and has lower glossiness.

The developing device 4M fixed at the most upstream position with respect to the rotational direction of the photosensitive drum, may be of contact or non-contact type shown in FIGS. 3 and 4. However, the developing devices 4C and 4Y are of non-contact type shown in FIG. 4. The developing device 4BK is non-contact type developing device shown in FIG. 5. By this choice, all of the developing devices 4C, 4Y and 4BK are prevented from physically destroying the toner image formed by the upstream developing device or devices on the photosensitive drum 1.

The developing device 4BK forms a non-magnetic toner image on the drum 1, but the developing device 4BK is fixedly disposed at the most downstream position. On the other hand, the developing devices 4M, 4C and 4Y using the two component developer form on the photosensitive drum 1 the non-magnetic toner images, respectively. Therefore, the developing devices 4C, 4Y and 4BK do not disturb the magnetic attraction force from the magnet in the sleeve the toner image or images formed on the drum by the upstream developing devices.

In addition, the developing devices 4C, 4Y and 4BK are prevented from accepting the different color toner from the toner image formed by the upstream developing devices.

In FIG. 7, the photosensitive drum 1 is uniformly charged by a primary charger 2 and exposed to a laser beam modulated in accordance with black image information, by way of the exposure means 3. Then, an electrostatic latent image is formed on the photosensitive drum. The electrostatic latent image is visualized into a black toner image by a black developing device 4BK. The black toner image is transferred by a transfer charger 6 onto a transfer sheet P on the transfer drum 5. After the image transfer, the photosensitive drum 1 is cleaned by a cleaning device 10 so that the residual toner is removed. Then, it is uniformly charged by the primary charger 2, again.

The photosensitive drum 1 is exposed to a laser beam modulated in accordance with magenta image information through the exposure means 3, so that an electrostatic latent image is formed. The electrostatic latent image is visualized into a magenta toner image by a magenta developing device 3M. The magenta toner image is transferred and overlaid on the black toner image on the transfer sheet P. Similarly, a cyan toner image is formed on the drum 1, and is transferred and overlaid on a magenta toner image on the transfer sheet P. Finally, a yellow toner image is formed on the drum 1 and is transferred onto the transfer sheet P and overlaid on the cyan toner image.

Accordingly, on the transfer sheet P, the black magnetic toner image is at the bottom among the four toner images. The transfer sheet having the four color toner images is fed into a heating and fixing device 11, where the four color toner images are simultaneously heated, fused and fixed.

In the embodiment of FIG. 7, a single driving motor 12 is commonly used to drive the developing devices. In other words, the driving force of the motor 12 is transmitted to the developing devices through clutched 14M, 14C, 14Y and 14BK associated with the respective developing devices. When clutches 14M, 14C and 14Y are engaged, the sleeve 102 and screws 85*a*, 85*b* and 88 of FIGS. 3 and 4 receive the driving force from the motor 12 to rotate. When the clutch 14BK is engaged, the sleeve 102 and the stirring rod 103 of FIG. 5 receive the driving force from the motor 12 to rotate.

The driving force required for driving the developing device using the two component developer, is larger than the driving force required for driving the developing device using the one component developer. This is because the magnetic confining force for the developer during the regulation of the layer thickness of the developer is larger in the case of the two component developer than the case of the one component developer.

In the case of the developing devices using the two component developer shown in FIG. 3 or 4, a means such as screws 85*a* and 85*b* is used to stir and feed the developer in the direction of the length of the sleeve in the opposite directions, in the container 101. This increases the required driving force. In the case of the developing device using one component developer shown in FIG. 5, the developer in the container can be sufficiently stirred by a single stirring member 103, and therefore, the force required for driving the stirring member is small. For these reasons, the force required for driving the developing device shown in FIG. 3 or 4 is larger than the force required for driving the developing device shown in FIG. 5.

For the reasons described above, it is not desirable to simultaneously transmit the driving forces from the motor 12 to more than two component developing devices, since then a large capacity motor 12 is required.

However, in the embodiment of FIG. 7, the developing operations are carried out in the order of the magenta developing device 4M, the downstream cyan and yellow developing devices 4C and 4Y this is done in order to present the simultaneous developing operation by two component developing devices. That is, the developing operation is carried out in the order from the upstream developing device to the downstream developing device with respect to the rotational direction of the photosensitive drum 1, it is not possible for two developing devices simultaneously operate. The clutches 14M, 14C and 14Y are engaged in this order, and there is no need of providing the time period in which two or three clutches are simultaneously engaged.

When a latent image for black component is formed, and thereafter, a latent image corresponding to a magenta image is formed, then there is a possibility that there is a time period in which both of the black developing device 4BK and the magenta developing device 4M are contemporaneously operated for development. This will be described in detail.

In the embodiment of FIG. 7, the photosensitive drum 1 and the transfer drum 5 have a diameter of 160 mm, and the developing zones for the developing devices are spaced by 35 degrees as seen from the rotational of the photosensitive drum 1, as shown in FIG. 7.

A distance K of no latent image area measured on the surface of the photosensitive drum 1 between a trailing edge of the latent image area for the black component and a leading edge of the latent image formation area for the magenta component, is so selected as to be substantially equal to a distance K' measured similarly in the rotating direction of the transfer drum between the trailing edge and the leading edge of the transfer material retained on the transfer drum 5. In the case of this embodiment in which the transfer drum 4 has a diameter of 160 mm, the distance K' between the leading and trailing edge of the transfer sheet is the minimum when two letter size transfer sheets are attracted on the transfer drum 4. The distance K' between the trailing edge of one of the transfer sheets and a leading edge of the other transfer sheet ($\approx$K) is:

$$K' = (160 \times \pi - 216 \times 2)/2 = 35.33 \text{ mm} \approx K$$

On the other hand, the circumferential length L of the photosensitive drum 1 between the developing zone of the black developing device 4Bk and the developing zone of the magenta developing device 4M is:

$$L = 160 \times \pi \times 35 \times 3/360 = 146.61 \text{ mm}$$

Therefore, $L > K \approx K$ with the result that there is a time period in which the black developing device 4BK and the magenta developing device 4M are operated simultaneously.

In other words, before the development operation of the black developing device 4BK for the black component, the magenta developing device 4M starts for the magenta component, so that the clutches 14BK and 14M are operated partly simultaneously.

However, the force required for driving the one component developer developing device is smaller than the driving force required by the other developing devices, the driving force required for simultaneously driving the developing devices 4M and 4BK is smaller than the driving force required for simultaneously driving the developing devices 4M and 4C or developing devices 4C and 4Y. For this reason, it is not required to increase the driving force of the motor 12 significantly, thus permitting use of small size motor 12. In addition, the degradation of the image quality can be prevented.

Figure 8:
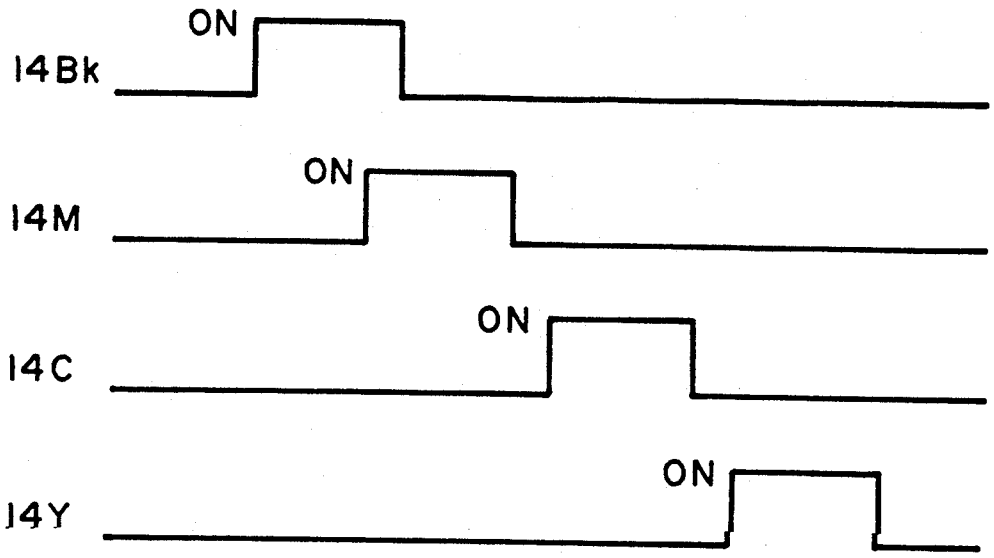
FIG. 8 is a timing chart for clutch operation in the apparatus of FIG. 7.

FIG. 8 shows a timing chart for the operation of each of the clutches. As regards the clutches 14M, 14C and 14Y, the engagement time period is not overlapped.

Figure 9:
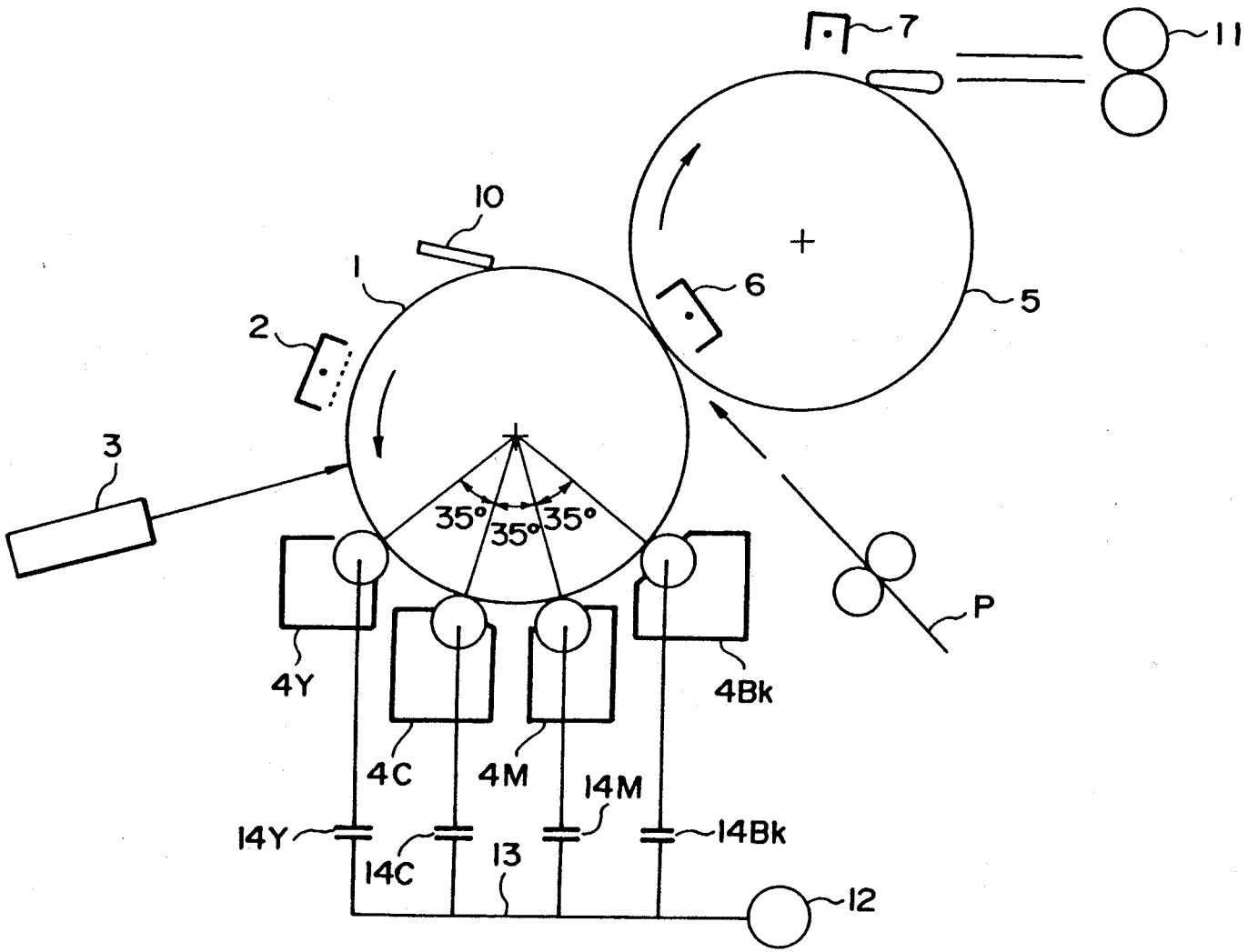
FIG. 9 is a sectional view of an image forming apparatus according to a further embodiment of the present invention.

FIG. 9 shows another example in which the order of the developing device arrangement is different, and also the diameters of the photosensitive drum 1 and the transfer drum 4 are 180 mm, which is different from the foregoing example. In the other respects, it is the same as FIG. 7 example.

In the example of FIG. 9, the developing devices are operated in the order from the most downstream device to the most upstream device. However, there is no overlapped operating time period of the developing devices.

Similarly in this embodiment, the distance K of the no-latent image formation region between the trailing edge of a latent image and a leading edge of the next latent image in the rotational direction of drum 1, is so set as to be substantially equal to the distance K' between a trailing edge of the transfer sheet carried on the transfer drum 5 and the leading edge of the transfer sheet in the direction of rotation of the transfer drum. The latter distance on the transfer drum 5 is the minimum when two letter size transfer sheets P are attracted on the transfer drum 5. More particularly, the circumferential length K' on the drum 5 between the trailing edge of one of the transfer sheet and the leading edge of the other sheet, is:

$$K'=(180\times\pi-216\times2)/2=66.74\text{ mm}\approx K$$

On the other hand, the circumferential length L on the drum 1 between the developing zones of adjacent developing devices, $$L=180\times\pi\times35\times/360=54.98\text{ mm}$$

Therefore, $L<K'\approx K$, so that any adjacent two developing devices are simultaneously operated.

Thus, the non-image-formation region between the latent images on the photosensitive drum 1 is made longer than the circumferential length of the photosensitive drum 1 between developing zones of adjacent developing devices, and therefore, even if the operation of the developing device proceeds from the downstream one to the upstream one, they are not operated simultaneously. Therefore, the capacity of the driving source for the developing devices is enough if it is capable of driving only one developing device, and therefore, it may be smaller than required by FIG. 7 embodiment.

Figure 10:
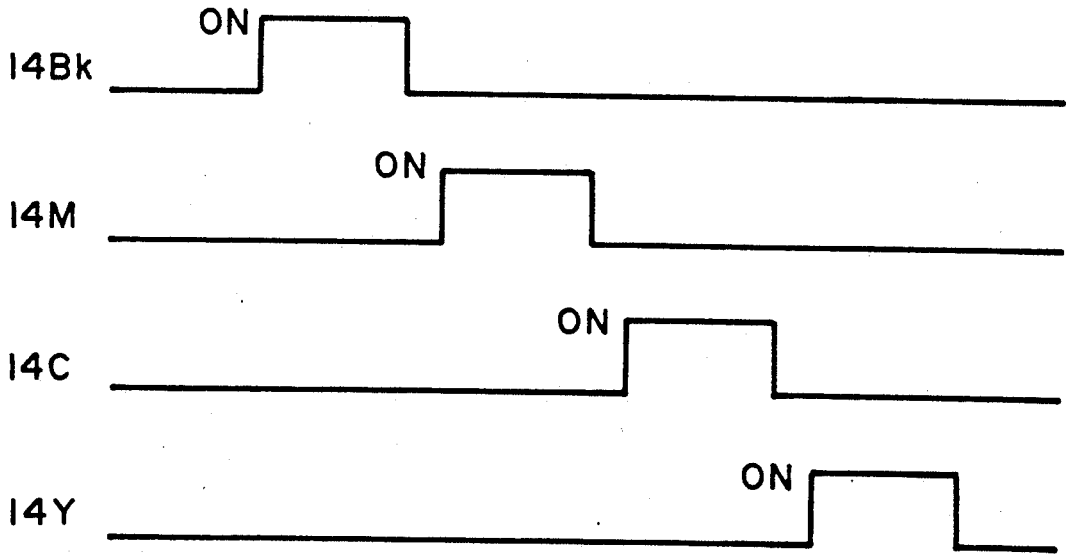
FIG. 10 is a timing chart for clutch operation in the apparatus of FIG. 9.

FIG. 10 is a timing chart for operation of clutches 14BK, 14M and 14C. As will be understood from this Figure, the operating period of the clutches, are not overlapped.

Figure 11:
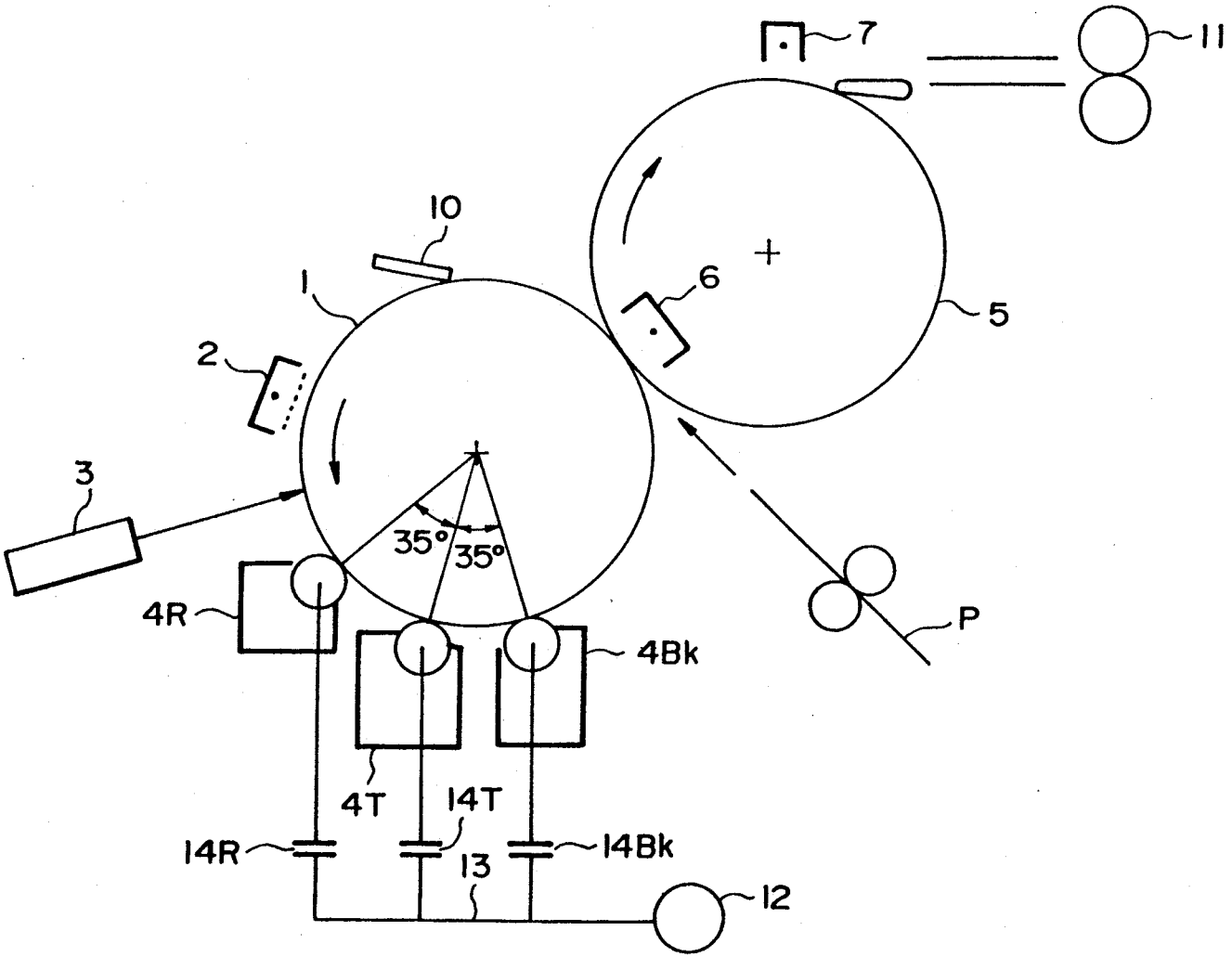
FIG. 11 is a sectional view of an image forming apparatus according to a further embodiment of the present invention.

FIG. 11 shows another embodiment which is a modification of FIG. 7 device, in which three developing devices 4M, 4C and 4Y are replaced with two developing devices 4R and 4T. The developing device 4R uses two component developer containing red non-magnetic toner and magnetic carrier particles and has a structure shown in FIG. 3 or 4. The developing device 4T contains a two component developer comprising transparent non-magnetic toner particles and magnetic carrier particles and has a structure shown in FIG. 4.

The clutches 14BK, 14R and 14T for the developing devices 4BK, 4R and 4T, are actuated in the timing shown in FIG. 8.

Figure 12:
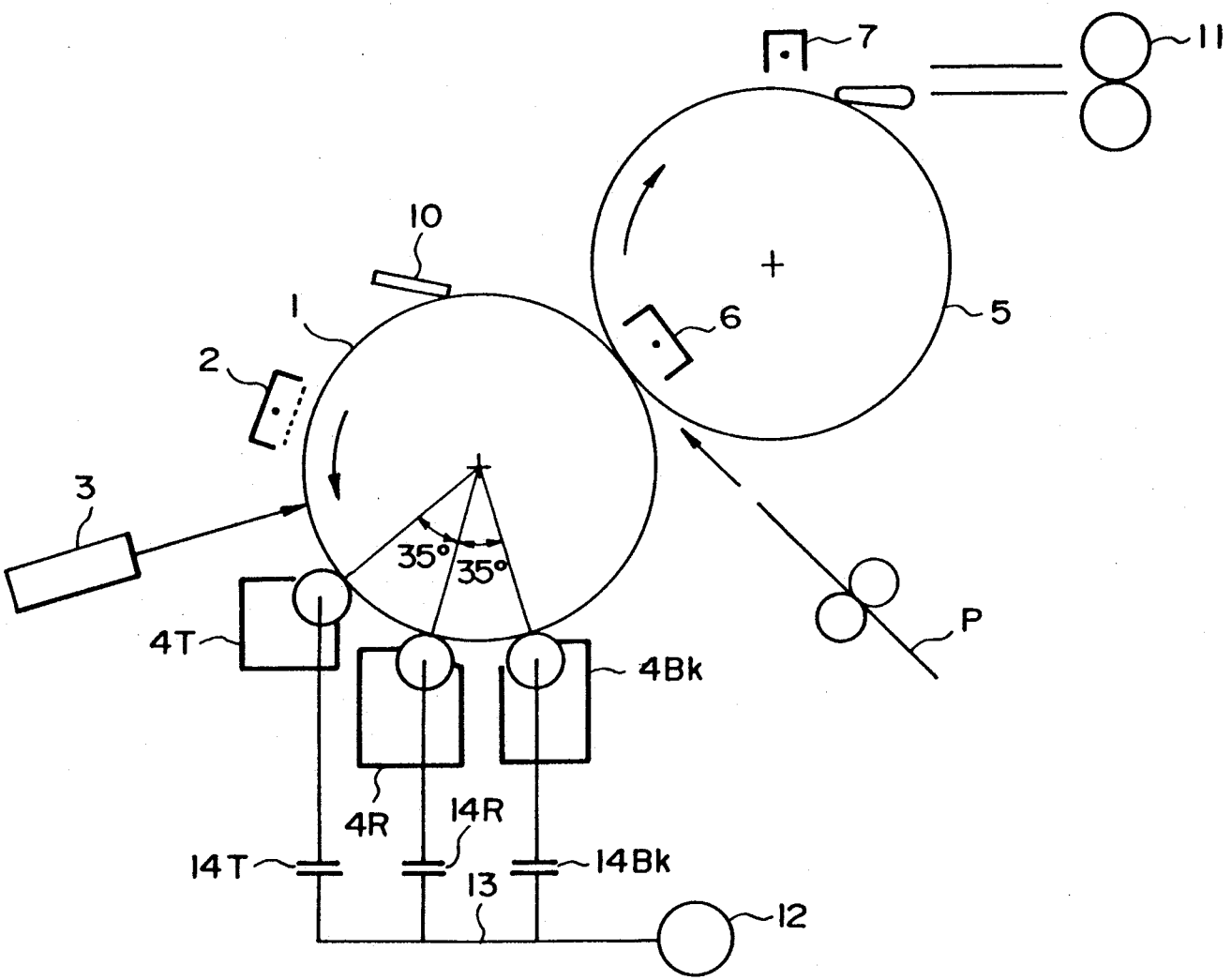
FIG. 12 is a sectional view of an image forming apparatus according to a further embodiment of the present invention.

FIG. 12 is a modification of FIG. 9 embodiment in which the three developing devices 4Y, 4C and 4M are replaced with two developing devices 4T and 4R, which have the same structure and toners as in FIG. 11 embodiment. The clutches 14BK, 14R and 14T operate in the timing shown in FIG. 14.

In the devices of FIGS. 11 and 12, the red toner image is overlaid on the black toner image on the transfer sheet P, and therefore, there is no inconvenience of difficulty in leading because of the red letter covered by black toner image.

The transparent toner is used to provide glossiness over the entire surface of the image fixed on the transfer sheet. Therefore, exposure means 3T functions to provide the toner receiving potential with the entire latent image area of the photosensitive drum 1 acted on by the developing device 4T. The transparent toner is transferred onto the entirety of the transfer sheet P. For this reason, the transparent toner developing device 4T is started with a delay from the black developing device 4BK. The apparatuses of FIGS. 1, 6, 7 and 9, are capable of forming so-called full-color images, and the apparatuses of FIGS. 11 and 12 are capable of forming two color images, but both are capable of black and white images such as characters.

In the black and white mode, the developing devices other than the black developing device 4BK, are not operated. When the black toner image formed on the photosensitive drum by the black developing device 4BK is transferred onto the transfer sheet P, the transfer sheet P is separated from the transfer drum 5 immediately, and is fed to an image fixing device 11, so as to prevent wasteful rotation of the transfer drum 5.

Therefore, in the black image formation mode, the number of copy images per unit time is larger than in the full-color mode or two color mode. In usual offices, the frequency of use is higher in the black mode than in the other modes.

Figure 13:
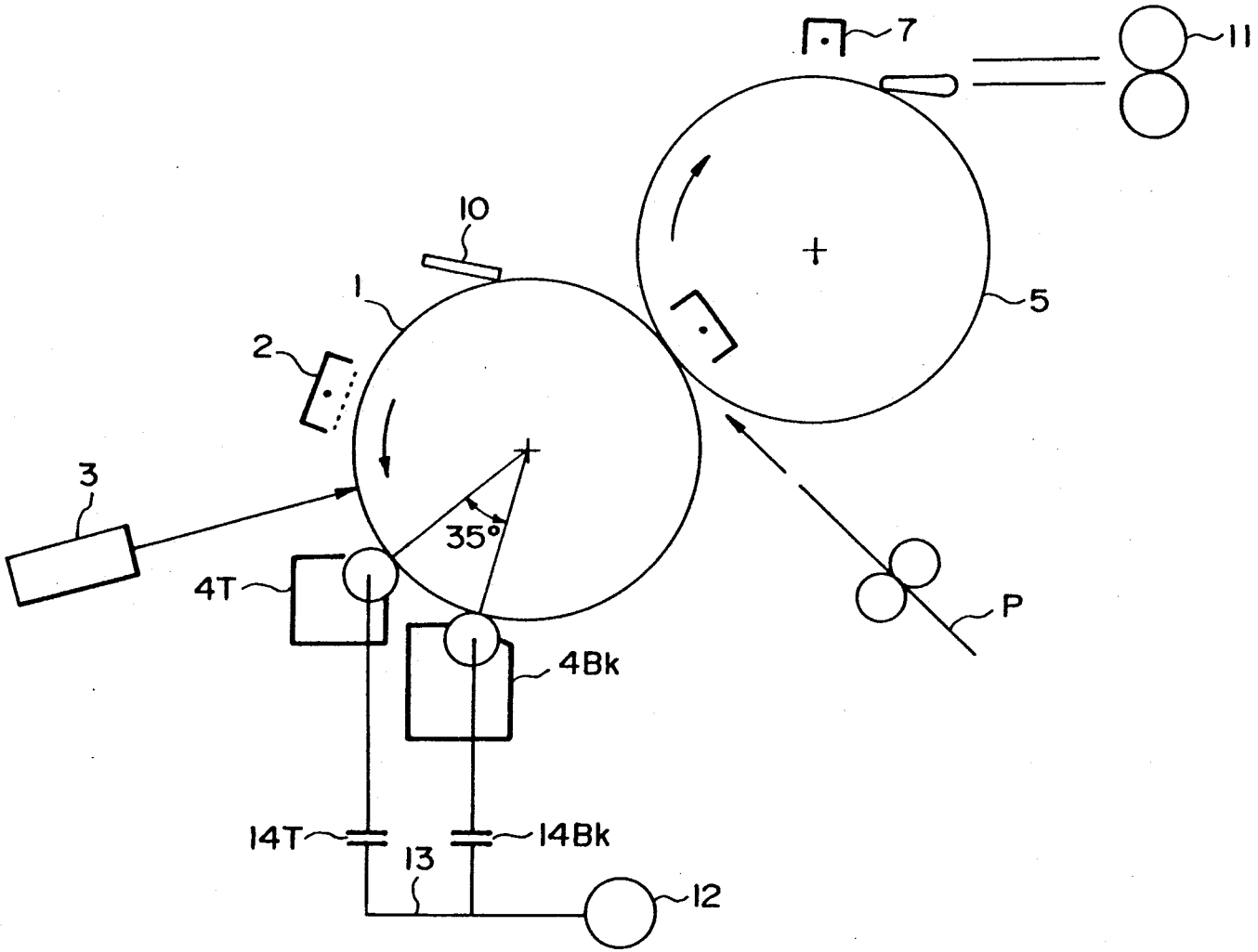
FIG. 13 is a sectional view of an image forming apparatus according to a further embodiment of the present invention.

In the apparatus of FIG. 13, black and white images can be formed. In this apparatus, the operation of the developing device containing the transparent toner may be selectively carried out.

The apparatus of FIG. 13 corresponds to a modification of FIG. 9 in which three developing devices 4Y, 4C and 4M are replaced with a single transparent developing device 4T. In a glossiness increasing mode, the clutches 14BK and 14T for the developing devices 4BK and 4T, are actuated at the same timings has the clutches 14BK and 14M of FIG. 10. Not in the glossiness increasing mode, the developing device 4T is not operated, and the developing device 4BK alone is operated, so that black toner image is formed on the transfer material P.

The black toner may have the fusing point of 180°-190° C., and the non-magnetic toner (non-black) may have the fusing point of 140°-150° C. These temperature ranges are preferable.

While the invention has been described with reference to the structures disclosed herein, it is not confined to the details set forth and this application is intended to cover such modifications or changes as may come within the purposes of the improvements or the scope of the following claims.

What is claimed is:

1. An image forming method, comprising:

a first toner image formation step for forming a first color image of magnetic toner;

a first image transfer step for transferring the first color image of the magnetic toner onto a transfer material;

a second toner image formation step for forming a second color image of a non-magnetic toner;

a second image transfer step for transferring the second color image of non-magnetic toner on the first color image of the magnetic toner on the same transfer material subsequently to the transfer of the first color image;

an image fixing step for simultaneously heating and fixing the first color image of the magnetic toner and the second color image of the non-magnetic toner on the transfer material;

wherein a glossiness of the magnetic toner for the first color image is lower than that of the non-magnetic toner for the second color image.

2. A method according to claim 1, wherein a fusing temperature of the magnetic toner for the first color image is higher than that of the non-magnetic toner for the second color image.

3. A method according to claim 1 or 2, wherein the magnetic toner is black toner.

4. An image forming apparatus, comprising:

an image bearing member;

latent image forming means for forming on said image bearing member a first electrostatic latent image for a first color and a second electrostatic latent image for a second color;

first developing means for developing a first electrostatic latent image with magnetic toner into a first color image;

second developing means for developing the second electrostatic latent image with non-magnetic toner into a second color image;

transfer means for transferring the first color image and the second color image onto the same transfer material in this order, wherein the second color image of the non-magnetic toner overlays, the first color image of magnetic toner on the transfer material; and fixing means for simultaneously heating and fixing the first and second color images on the transfer material, wherein a glossiness of the magnetic toner for the first color image is lower than that of the non-magnetic toner for the second color image.

5. An apparatus according to claim 4, wherein a fusing temperature of the magnetic toner for the first color image is higher than that of the non-magnetic toner for the second color image.

6. An apparatus according to claim 4 or 5, wherein the first color toner is black toner.

7. An image forming apparatus, comprising:

a first image bearing member;

first latent image forming means for forming a first electrostatic latent image on said first image bearing member;

first developing means for developing the first electrostatic latent image with magnetic toner into a first color image;

a second image bearing member;

second latent image forming means for forming a second electrostatic latent image on said second image bearing member;

second developing means for developing the second electrostatic latent image with non-magnetic toner into a second color image;

feeding means for feeding a transfer material in a predetermined path along which said first image bearing member and said second image bearing member are disposed, wherein said first image bearing member is disposed upstream of said second image bearing member with respect to a feeding direction of the transfer material;

transfer means for overlapping and transferring the first color image and the second color image on the same transfer material in this order, wherein the second color image of the non-magnetic toner exists on the first color image of the magnetic toner on the transfer material;

fixing means for simultaneously heating and fixing the first and second color images on the transfer material, wherein a glossiness of the magnetic toner for the first color image is lower than that of toner for the second image.

8. An apparatus according to claim 7, wherein a fusing temperature of the magnetic toner for the first color image is higher than that of the non-magnetic toner for the second color image.

9. An apparatus according to claim 7 or 8, wherein the magnetic toner is black toner.

10. An image forming apparatus, comprising:

a rotable image bearing member;

latent image forming means for forming on said image bearing member a first electrostatic latent image in a latent image forming station;

first developing means for developing in a first developing zone a first electrostatic latent image into a magnetic black toner image, said first developing means including a first rotable developer carrying member for carrying magnetic toner to the first developing zone, and a first magnet in said developer carrying member;

second developing means for developing in a second developing zone a second electrostatic latent image into a non-magnetic color toner image subsequent to the development of the first electrostatic latent image by said first developing means, said second developing means including a second rotatable developer carrying member for carrying a developer comprising non-magnetic toner and magnetic carrier particles to the second developing zone, and a second magnet in said second developer carrying member, wherein the second developing zone is disposed downstream of the latent image forming station and upstream of the first developing zone with respect to a rotational direction of said image bearing member;

transfer means, disposed in a transfer station downstream of the first developing zone with respect to the rotational direction of said image bearing member, for overlapping and transferring the magnetic toner image and the non-magnetic toner image in this order on the same transfer material, wherein the second color image of the non-magnetic toner overlays the first color image of the magnetic toner on the transfer material; and fixing means for heating and fixing simultaneously the magnetic toner image and the non-magnetic toner image on the transfer material.

11. An apparatus according to claim 10, wherein a distance between said second developing zone and said first developing zone is shorter than a distance along the surface of said image bearing member from a trailing edge of the first electrostatic latent image and a leading edge of the second electrostatic latent image, said apparatus further comprising a driving motor and a drive transmission switching means for transmitting a driving force of the driving motor selectively to said first developing means and said second developing means, whereby when the driving force of said driving motor is transmitted to said first developing means, said second developing means is at rest, whereas when the driving force is transmitted to said second developing means, said first developing means is at rest.

* * * * *

UNITED STATES PATENT AND TRADEMARK OFFICE

CERTIFICATE OF CORRECTION

PATENT NO. : 5,285,246

DATED : February 8, 1994

INVENTOR(S) : TOSHIMITSU DANZUKA, ET AL.

It is certified that error appears in the above-indentified patent and that said Letters Patent is hereby corrected as shown below:

ABSTRACT [57],

Line 1, "method an" should read --method and--;
Line 6, "of a non-magnetic toner" should be deleted; and
Line 7, "image; a" should read --image of a non-magnetic toner; a--.

Column 1,

Line 17, "block (BK)" should read --black (BK)--; and
Line 34, "chine" should read --chines--.

Column 2,

Line 13, "persons" should read --person's--.

Column 3,

Line 21, "D/A converter 101," should read --by D/A converter 101,--; and
Line 39, "is" should read --are--.

Column 4,

Line 25, "toner" should read --toners--.

UNITED STATES PATENT AND TRADEMARK OFFICE

CERTIFICATE OF CORRECTION

PATENT NO. : 5,285,246
DATED : February 8, 1994
INVENTOR(S) : TOSHIMITSU DANZUKA, ET AL.

It is certified that error appears in the above-indentified patent and that said Letters Patent is hereby corrected as shown below:

Column 5,
Line 58, "developer 8" should read --developer 80--.

Column 6,
Line 1, "developer 8" should read --developer 80--;
Line 38, "rise" should read --rises--;
Line 53, "comprises" should read --comprising--; and
Line 68, "supplies" should read --supplied--.

Column 7,
Line 7, "a" should read --an--, and "of capable" should read --as to be capable--; and
Line 50, "drum." should read --drums.--.

Column 9,
Line 16, "clutched" should read --clutches--;
Line 54, "4Y this" should read --4Y. This--; and
Line 55, "present" should read --prevent--.

UNITED STATES PATENT AND TRADEMARK OFFICE

CERTIFICATE OF CORRECTION

PATENT NO. : 5,285,246

DATED : February 8, 1994

INVENTOR(S) : Toshimitsu Danzuka, et al

It is certified that error appears in the above-indentified patent and that said Letters Patent is hereby corrected as shown below:

Column 10,
Line 31, "4Bk" should read --4BK--.

Column 11,
Line 65, "leading" should read --reading--.

Column 12,
Line 36, "has" should read --as--.

Column 13,
Line 27, "overlays," should read --overlays--; and
Line 41, "first color" should read --magnetic--.

UNITED STATES PATENT AND TRADEMARK OFFICE

CERTIFICATE OF CORRECTION

PATENT NO. : 5,285,246

DATED : February 8, 1994

INVENTOR(S) : TOSHIMITSU DANZUKA, ET AL.

It is certified that error appears in the above-indentified patent and that said Letters Patent is hereby corrected as shown below:

Column 14,

Line 7, "toner" should read --the non-magnetic toner--; and

Line 8, "second image." should read --second color image--.

Signed and Sealed this

Sixth Day of September, 1994

Bruce Lehman

*Attest:*

BRUCE LEHMAN

*Attesting Officer*

*Commissioner of Patents and Trademarks*